US009339910B2

(12) United States Patent
Mahler et al.

(10) Patent No.: US 9,339,910 B2
(45) Date of Patent: May 17, 2016

(54) GRINDING MACHINE FOR THE GRINDING OF SPRING ENDS

(75) Inventors: John Ian Mahler, Oxfordshire (GB); Keith Manners, Redditch (GB); Kevin Walker, Redditch (GB)

(73) Assignee: BENNETT MAHLER LIMITED, Redditch, Worcestershire (GB)

( * ) Notice: Subject to any disclaimer, the term of this patent is extended or adjusted under 35 U.S.C. 154(b) by 128 days.

(21) Appl. No.: 13/982,260

(22) PCT Filed: Feb. 3, 2012

(86) PCT No.: PCT/GB2012/050225

§ 371 (c)(1),
(2), (4) Date: Jul. 27, 2013

(87) PCT Pub. No.: WO2012/104646

PCT Pub. Date: Aug. 9, 2012

(65) Prior Publication Data

US 2013/0303058 A1 Nov. 14, 2013

(30) Foreign Application Priority Data

Feb. 3, 2011 (GB) ..... 1101847.0

(51) Int. Cl.

| | |
|---|---|
| ***B24B 7/00*** | (2006.01) |
| ***B24B 7/16*** | (2006.01) |
| ***B24B 7/17*** | (2006.01) |

(52) U.S. Cl.
CPC . *B24B 7/16* (2013.01); *B24B 7/167* (2013.01); *B24B 7/17* (2013.01)

(58) Field of Classification Search
USPC ..... 451/119, 120, 121
See application file for complete search history.

(56) References Cited

U.S. PATENT DOCUMENTS

| | | | | |
|---|---|---|---|---|
| 2,315,859 | A | 4/1943 | Inge | |
| 3,555,738 | A * | 1/1971 | Neal et al. | 451/164 |
| 4,067,701 | A * | 1/1978 | Horvath et al. | 451/121 |
| 4,347,689 | A | 9/1982 | Hammond | |
| 4,404,772 | A * | 9/1983 | Snyder | 451/8 |
| 7,530,879 | B2 * | 5/2009 | Wagner et al. | 451/5 |

FOREIGN PATENT DOCUMENTS

| | | |
|---|---|---|
| GB | 718087 A | 11/1954 |
| GB | 1381052 | 1/2004 |
| GB | 2484358 | 4/2012 |
| GB | 2484558 | 9/2012 |
| JP | 2005088086 | 4/2005 |

* cited by examiner

*Primary Examiner* — Lee D Wilson
*Assistant Examiner* — Shantese McDonald
(74) *Attorney, Agent, or Firm* — NWAMU, P.C.

(57) ABSTRACT

A grinding machine for grinding an end of a spring, the machine comprising a fixed spring mounting, which is fixable in a known position in the machine, for a spring or springs and a grinding surface secured to a support structure and arranged with the support structure to relatively oscillate to and fro along an oscillation path or cycle across one end of the mounting.

20 Claims, 4 Drawing Sheets

GRINDING MACHINE FOR THE GRINDING OF SPRING ENDS

This invention generally relates to grinding machines and more particularly to a grinding machine used for grinding the wire ends of springs to provide flattened ends.

Springs are used in a wide range of applications. In many cases the ends of the spring need to be ground perpendicular to their longitudinal axis in order to meet the load requirements of the spring. Traditionally, the spring is located in a grinding machine through a mounting and a relatively complex mechanism provided to create relative movement between the spring or springs in a dynamic reciprocating mounting and a rotating grinding surface. Relative movement is needed to spread wear on the grinding surface and to facilitate the grinding process. The mounting for the spring or springs is generally a jig or clamp and provides through an appropriate reciprocating mechanism the relative movement between the mounting and the grinding surface. The grinding surface is generally a grinding wheel, possibly of a meter or more diameter, with a significant mass so as well as being cumbersome in terms of size the grinding surface is rotating at a relatively high speed so movement of a much lighter and normally accessible spring mounting assembly is provided.

It will be understood that the grinding process is inherently 'dirty' and provides a hostile environment for such components as bearings and drive mechanisms. Thus, prior manipulated mountings for springs have been subject to premature or early failure of bearings and oscillation drive mechanisms. Furthermore, switching mountings for different sizes of spring or eccentricity is cumbersome and time consuming.

In accordance with aspects of the present invention there is provided a grinding machine for grinding an end of a spring, the machine comprising a fixed spring mounting, which is fixable in a known position in the machine, for a spring or springs and a grinding surface secured to a support structure and arranged within the support structure to relatively oscillate to and fro along a guided oscillation path or cycle across one end of the spring mounting with the grinding surface for continuous contact in use with at least one end of one spring and means to advance the continuous contact to flatten each end of the spring or springs to the grinding surface The grinding surface may be reciprocating laterally across the end of the mounting. The grinding surface may rotate on a shaft. The grinding surface may comprise a driven abrasive belt driven substantially laterally across the end of the mounting.

Possibly, a shaft or presenter for the grinding surface extends through a partition to isolate the mounting from a grinding drive mechanism for the grinding surface and/or an oscillation drive mechanism for the support structure to drive the grinding surface along the oscillation path. Possibly, the shaft or presenter extends thorough a seal. The seal may be a bellows boot and/or a baffle seal associated with the partition. The partition may be a wall between separate compartments of the machine.

The support structure is not capable of articulation and is possibly substantially stable. The support structure may include a platform or carrier. The platform or carrier may be presented upon a bed surface or track. Possibly, an interengagement of the support structure upon the bed surface or track at least partly defines the oscillation path. Possibly the shaft or presenter can rock or tilt in or on the support structure. The support structure may be a first housing or cabinet surrounding the grinding surface and the whole or a chassis part of the first housing displaced to provide relative oscillation to and fro along the oscillation path or cycle.

The oscillation path or cycle may be lateral and/or horizontal and/or vertical and/or angled from one end of the path or cycle to the other and/or curved. The oscillation path or cycle may have a wavy section or portion. The wavy section or portion possibly is square or saw-tooth or harmonic or non-harmonic.

The oscillation drive may include a crank arm between the support structure and a prime mover such as a motor. The machine may have mountings to the support structure to allow crank arms of different length to be associated with the machine. The crank arm is shaped to define in part the oscillation path in use. The crank arm may be of a fixed length in use along the oscillation path or cycle. The crank arm may be straight or curved. Alternatively, the oscillation drive may include a pneumatic or hydraulic ram or a servo motor drive.

Possibly the known position of the mounting for the spring is above or below or to one or the other side of the shaft in use to a pre-determined extent through fixings to a frame or housing within the machine. Possibly the pre-determined extent is variable by use of different fixings.

The grinding drive mechanism and the oscillation drive mechanism may have a common prime mover such as a motor or separate prime movers such as motors. A common prime mover may have a transmission with a gear box to distribute prime movement to the grinding drive mechanism and the oscillation drive mechanism.

The spring mounting may comprise jigs for a plurality of elements. The jigs may be configured to receive helical springs held in a form of Vee recess on one side and a flat plate on the other. However, other forms of jig and clamps may be used. The mounting may have a standard size irrespective of the number of jigs or clamps in the mounting.

The machine may be arranged to have two grinding surfaces to alternately or simultaneously grind in use opposite ends of a spring or springs. The spring mountings may be presented on a rotatable carousel fixable in at least two positions to present in use the spring or springs with respective opposite ends of each spring towards the grinding surface. The carousel may be associated with a feed mechanism whereby further springs may be loaded into the carousel whilst one spring or set of springs has an end presented in use to the grinding surface.

The grinding machine may operate dry or with water or other coolant provided and/or with a lubricant to facilitate grinding.

Embodiments of aspects of the present invention will now be described by way of example only with reference to the accompanying drawings in which.

Figure 5:
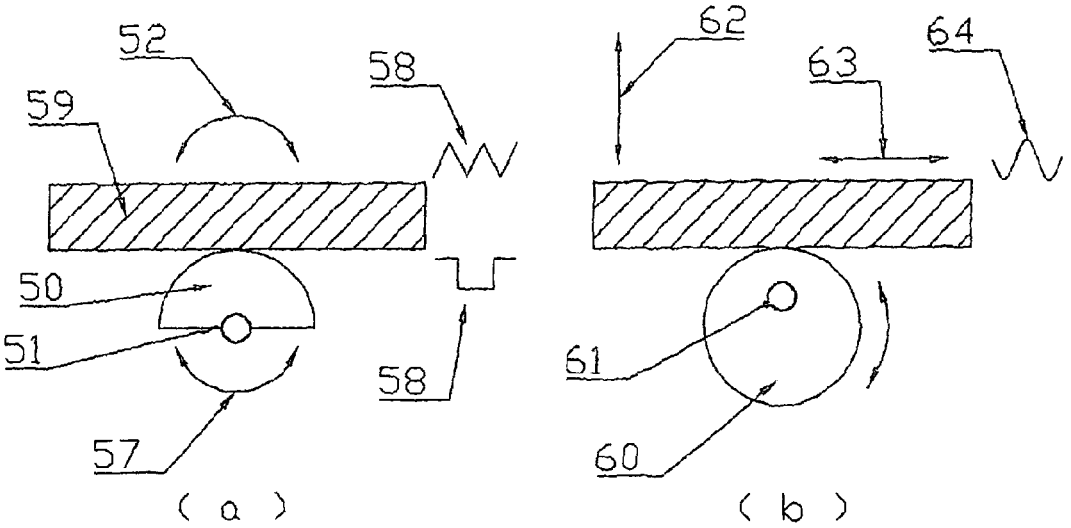
Figure 7:
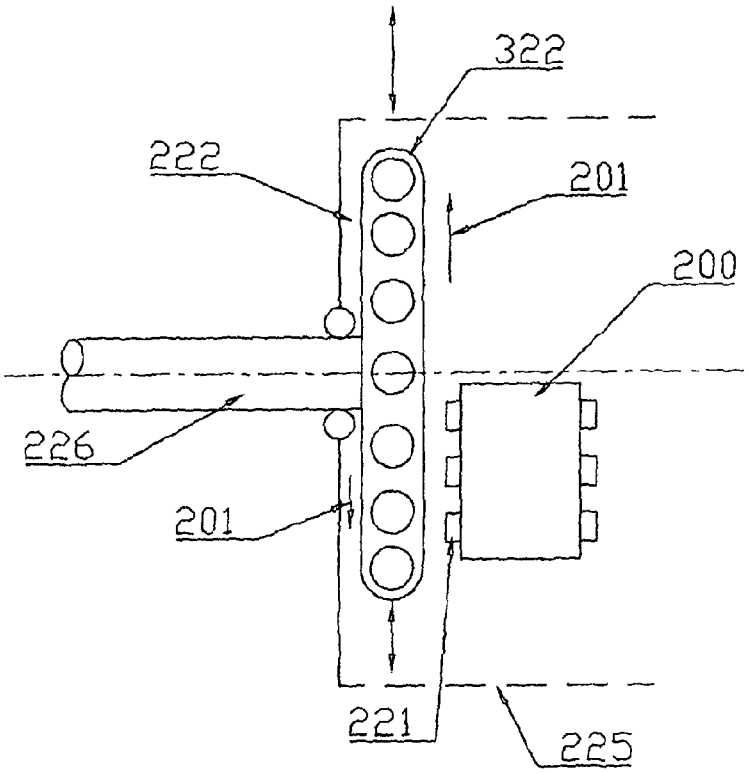
Figure 8:
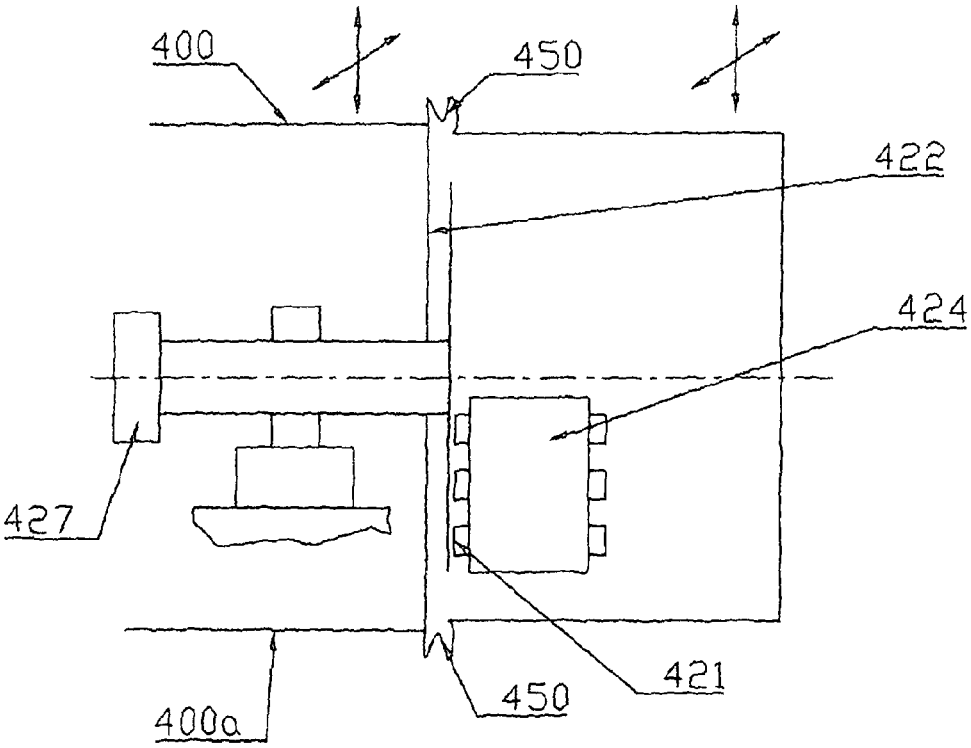

FIG. 5 a & b provides schematic illustrations of wheel support structures to create different oscillation paths and cycles if required;

FIG. 6*a-f* provides illustrations of a grinding machine in accordance with aspects of the present invention through a typical oscillation path or cycle;

FIG. 7 is a schematic illustration of an abrasive belt to act as a grinding surface in accordance with aspects of the present invention; and, FIG. 8 is a schematic illustration of an alternative embodiment of aspects of the present invention.

During their manufacture it will be appreciated that springs are often initially wound or formed on a former or spindle. Thus, the ends are not flat due to the cross-section of the wire at the spring ends. Flat ends for the springs are required for load distribution, stability and other factors in use. The problems of wire cross-section at spring ends are particularly present with larger springs. In such circumstances the ends are ground to a substantially flat configuration by clamping the spring in a jig to expose the end to a grinding surface such as a rotatable grinding wheel to taper the wire at the spring end to a substantially flat perspective.

Figure 1:
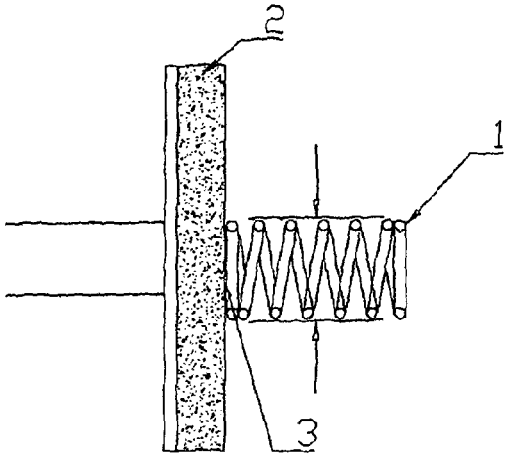
FIG. 1 is a schematic illustration of an end of a spring grinding against a rotatable grinding surface.

FIG. 1 provides a simple schematic view of a spring 1 formed from wound wire engaging a rotatable grinding surface 2 to taper the round wire cross-section to create a flat end. To facilitate the grinding process relative movement of an end 3 to the surface 2 must be provided. Such movement will reduce localised wear on the grinding surface 2 but also aids abraded metal/grit removal, temperature control at the abrasion site and possibly striation or similar effects both of the spring end 3 and the grinding surface 2. Previously, such relative movement has been achieved by moving the holder or mounting for the spring. The holder or mounting is much lighter than the grinding surface and so much easier to manipulate. Unfortunately, any mechanism for manipulation of the holder/mounting is also exposed to the grit/metal debris created by the grinding process and at relatively high velocities so causing premature wear and/or a need for expensive maintenance.

Figure 2:
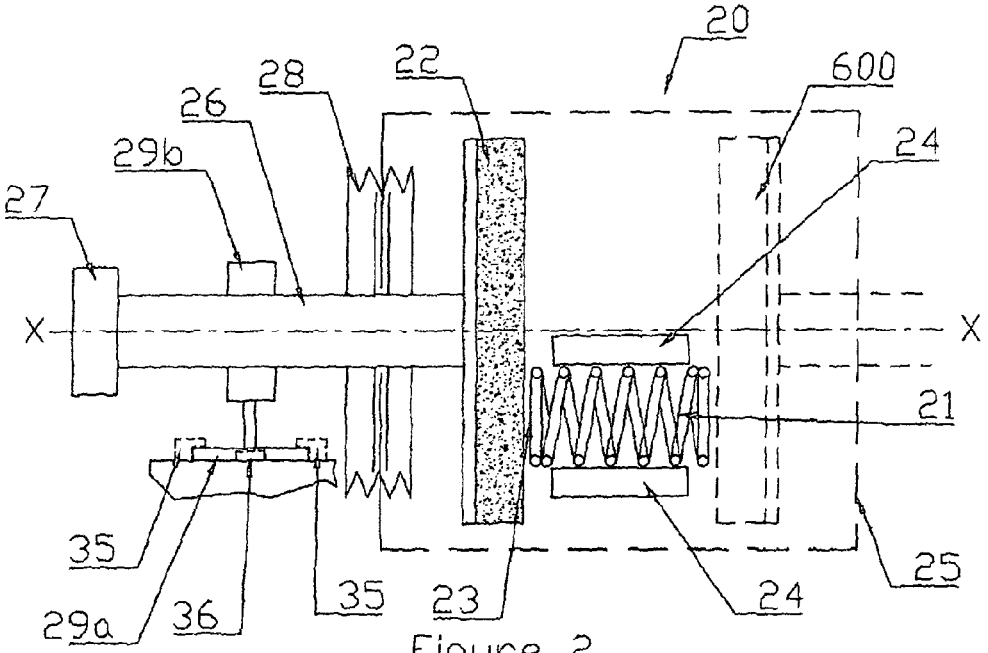
FIG. 2 is a schematic side cross-sectional illustration of a grinding machine in accordance with aspects of the present invention.

FIG. 2 is a schematic side cross-sectional illustration of a grinding machine 20 in accordance with aspects of the present invention. The machine 20 comprises a holder or mounting 24 for a spring 21 in order to present the spring 21 to a grinding surface 22 whereby an end 23 can be ground to a desired flat configuration. A broken line 25 defines what in use would normally be a containment in the form of a housing or cabinet for debris such as abraded material as a result of the grinding process as well as lubricants, wash solutions etc. The debris is generally propelled at high speed due to the rotational speed of grinding surface and so requires containment but it will be appreciated that the mountings 24 are exposed. If the mechanism for manipulation of the mountings 24 is similarly exposed they must be regularly maintained or replaced and probably be of a more robust nature than possibly necessary for other reasons. The means of locating and positioning the spring 21 is normally a simple jig or vee clamp within the mounting and able to accommodate several springs 21 at one time. Ideally the jig is of a cassette type format to allow ready switching but this may add further to complications were a prior mounting manipulation mechanism is exposed to grit/debris wash as a result of the grinding process.

Aspects of the present invention provide a fixed location for a spring mounting 24 typically in a box or housing to provide a closed environment or containment (broken line 25) about the mounting 24 and work piece that is to say the spring or springs 21 in the mounting 24. The mounting 24 is simply secured by bolts or similar fasteners in the housing or container possibly through a door or hatchway in a side or end. Relative movement between the spring 21 and the grinding surface 22 is through oscillation of the grinding surface 22 across the mounting 24 and so the end 23 of the spring 21. As will be described later the oscillations are normally lateral (horizontal or vertical or a diagonal slope) but possibly could be curved or wavy. The grinding surface 22 is in continuous contact with the or at least one spring 21 end so that the motion is flat without steps or jerks in motion. Thus, although the initial contact by the grinding surface is with an angular corner of a thick wire end from which the spring is formed this pointed and angular engagement is ground flat as a growing flat chamfer by progressive movement or advancement of the grinding surface towards the spring along the major axis of the spring. Continuous engagement ensures correct presentation of the grinding surface with less vibration upon the spring with stepped or jumped changes on loading if contact was broken. Keeping contact with one of several spring ends to be ground at the same time means the orientation, configuration and presentation of the grinding surface for all spring ends is substantially maintained in a flat oscillation as contact with one spring end will prevent too rapid, and stepped, inward or advancement of the grinding surface towards the spring ends of all the springs.

The grinding surface 22 as previously is normally a wheel arranged to rotate at a rotational speed necessary or desirable to provide a grinding function for the spring 21 in terms of its structure as well as material type but also for desired production scheduling. The surface 22 is presented on a shaft 26 with a rotation drive mechanism 27 normally in the form of a motor to act as a primary mover to turn the shaft and so the grinding surface. However, as described later other reciprocating grinding surfaces can be used including abrasive belts and possibly wire bristles. There may be a gear box or other transmission to deliver a desired reciprocation or rotational speed for the surface 22 as required at start up or for variation during the grinding process, if required, but normally the grinding surface 22 or wheel will be arranged to attain a desired rotational speed prior to initiating the grinding process in engagement with the spring 24 at the end 23. In such circumstances the grinding surface 22 or wheel will simply advance towards the spring end 23 as described below.

The shaft 26 extends through a seal 28 in a partition wall or surface between the mounting 24/environmental debris in the containment (broken line 25) and the drive mechanism 27 and means 29 for manipulation of the shaft 26 and so surface 22 along an oscillation path or cycle relative to and across the end 23 of the spring 21. The seal 28 is normally of a bellows type to accommodate the range of travel of the particular oscillation path or cycle used for a current spring or springs 21 subject to the grinding process. The means 29 of manipulation of the shaft 26 may allow performance of a number of oscillation paths or cycles but there will tend to be known ranges for oscillation in use with the shaft 26 or other presenter and so surface 22 travelling between these ends to and fro along the oscillation path or cycle in use. The purpose of the seal 28 is to stop damaging debris getting to the means 29 of manipulation and the drive mechanism 27 so alternatives to a bellows boot type seal may be used where appropriate. The seal 28 will also normally include a labyrinth or baffle seal arrangement again to stop grit and debris ingress.

It will be understood that grinding machines can be used on a wide variety of springs both large and small with different materials and responses to grinding. The grinding surface 22 is heavy but may also engage varying parts of the end 23. Thus, the forces to which the surface 22 and so means 29 of manipulation are exposed will also vary and may be quite high. In accordance with aspects of the present invention the means 29 comprises a support structure for the shaft 26 which is stable without articulation and so provide a more consistent presentation of the shaft 26 and so the surface 22 in use along the oscillation path and cycle. If the support structure for the shaft were itself to create oscillation or change dynamically then the operator desired engagement with the spring would be more likely to be variable in use due to wide variations in presented forces to the support structure during the grinding process. The less the support structure can flex with the heavy weight of the grinding surface and the variations in load forces the more consistent will be the grinding process with less wear and tear.

Figure 3:
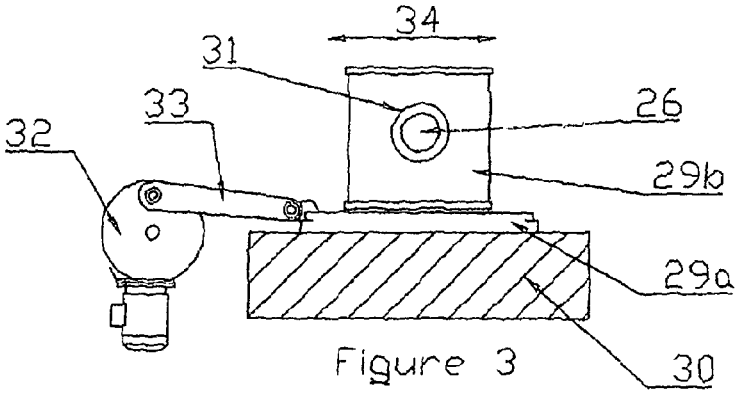
FIG. 3 is a schematic end view with a rotatable grinding surface and spring mountings removed.

The support structure in accordance with aspects of the present invention is shown in a schematic front cross-sectional view in FIG. 3. The same reference nomenclature has been used as that used in FIG. 2 for comparison. The support structure 29 in the embodiment depicted comprises a platform 29*a* and an arm in the form of an upright 29*b* as depicted. The platform 29*a* engages means to create oscillation in the embodiment depicted but it is possible that the means for oscillation could engage the upright 29*b* in other embodiments. The platform 29*a* sits on a base 30 and normally slides to and fro with the oscillations along the oscillation path or cycle for desired contact between the grinding surface and the end of the spring. The arm or upright is robust and presents a bearing 31 for the shaft 26 for consistent presentation in the support structure 29 in use. Thus, oscillation along the oscillation path or cycle in use is substantially and ideally wholly dependent only on the support structure inter-action with the base 30 and an oscillation drive mechanism 32. The drive mechanism 32 drives the platform 29*a* across the base 30 in a steady way. The motion is guided by the platform 29*a* engaging the base 30 so in the embodiment illustrated is substantially linear but it is possible to create other motions to at least a certain extend as described latter if required. By having a steady linear motion it will be understood that there will be greater predictability in the grinding process as well as possibly less wear and tear on the machine in use. Jerky movements may put additional stressing on the grinding machine so continuous contact with a spring to maintain orientation and configuration of progressive grinding is desirable. The oscillation drive mechanism normally has a motor as the prime mover and a crank arm 33 connection to the platform 29*a* or arm 29*b* to generate oscillation movement along the oscillation path or cycle. The arm 33 may be straight or curved to create the desired movement in the support structure 29 for the shaft 26.

The rotational drive mechanism 27 for the shaft 26 and the oscillation drive mechanism 32 may be separate as depicted in FIG. 2 and FIG. 3 or may use a common motor as a prime mover with an appropriate transmission or gearbox to give the necessary rotational speed for the shaft and oscillation rate for the grinding surface.

As depicted in FIG. 3 the base 30 may be flat and secured to a substantial table/chassis or housing for stability in use. Thus, as shown the oscillations in the direction of arrowheads 34 will be lateral and typically substantially horizontal across the end 23 of the spring 21 (FIG. 2) with continuous contact for progressive advancement to flatten the end of the spring. However, it will be understood that the base could be turned to a vertical orientation so the oscillations in the shaft and so the grinding surface will then also be vertical but it may also in such circumstances be necessary to prove a guide rail or channel to capture association between the platform and the base. In any event as illustrated in FIG. 2 by broken lines 35, 36 rails or channels can be used to guide oscillation to ensure the motion is lateral in a horizontal and linear direction. Furthermore, by such an approach the grinding surface is confined to lateral oscillations and so cannot jump out of contact with the spring end or deviate from the continuous substantially flat oscillation across the end of the spring. As the channels and rails are not exposed to the grinding debris such guiding can be more readily achieved with more consistency and less concern with regard to wear and tear.

Figure 4:
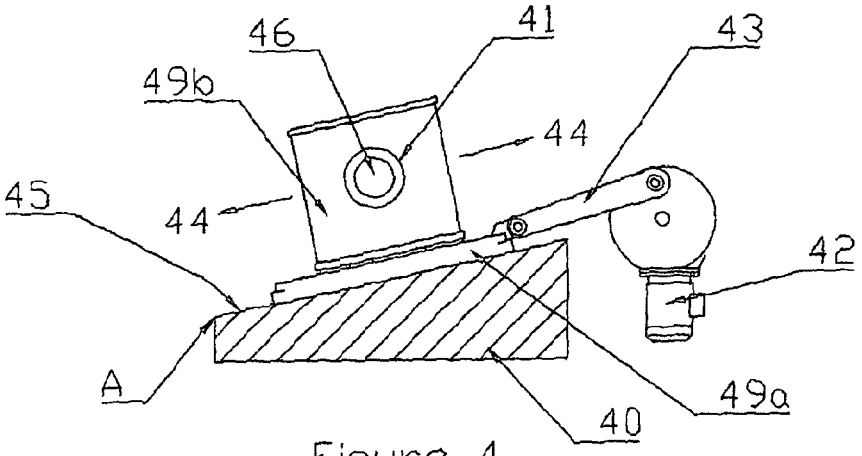
FIG. 4 is a schematic illustration of an end cross-section showing how a diagonal oscillation path can be provided.

FIG. 4 illustrates how if desired a diagonal or sloped oscillation path across the end face of a mounting and so a spring can be achieved. A platform 49*a* with an arm 49*b* are arranged to act together to form a support structure for a bearing 41 and shaft 46. The platform 49*a* engages an inclined base 40 whereby oscillation is provided by relative slide there between. The drive for such motion is given by a motor 42 through a crank 43 connected to the arm 49*b*. Thus, the oscillation path or cycle is in the direction of arrowheads 44. The angle A of an engaged upper surface 45 determines the angle of the diagonal or sloped oscillation path or cycle subtended by the shaft 46 and so a grinding surface (not shown).

As indicated above generally the oscillation path will be linear, flat and lateral (horizontal or vertical or diagonal). A further alternative is to provide some oscillation in a horizontal plane (flat with continuous contact) by presenting a platform or a base on a curved former. FIG. 5 provides two alternatives a & b for such curved oscillation formers 50, 60. In FIG. 5*a* the former 50 has a half circle or domed cross-section so a platform or base 59 can 'rock' over the former 50 creating a curve in the lateral path or cycle across the end of the spring in a mounting for a shaft and so grinding surface secured thereto. The rocking motion is depicted by arrowheads 52. The former 50 may tilt itself about a pivot 51 or be fixed but in either event the platform or base 59 will slide, with or without, lubricant over the former 50 in use. A further alternative if the oscillation former 50 completely rotates is that saw tooth 58 or square wave oscillations in the flat plane across the spring end can be provide by turn over but with additional vibration and jerky motions.

The oscillation former 60 takes the form of an ellipse or off-centre circle or asymmetric ovoid in cross-section with a key-ed or frictional traction with a bottom surface of a base or platform 69. Thus, as the platform or base 69 is driven across the former 60 the off-set or asymmetric nature of the former 60 as it turns on a spindle 61 raises and lowers the platform or base 69 in the direction of arrowheads 62 which translates with the general movement of the base or platform in the direction 63 due to the oscillation drive mechanism into a wavy motion 64 across the perpendicular plane of the mounting and so spring end in use. Depending on the shape of the former 60 this wavy oscillation may be symmetrical or non-symmetrical.

Figure 6:
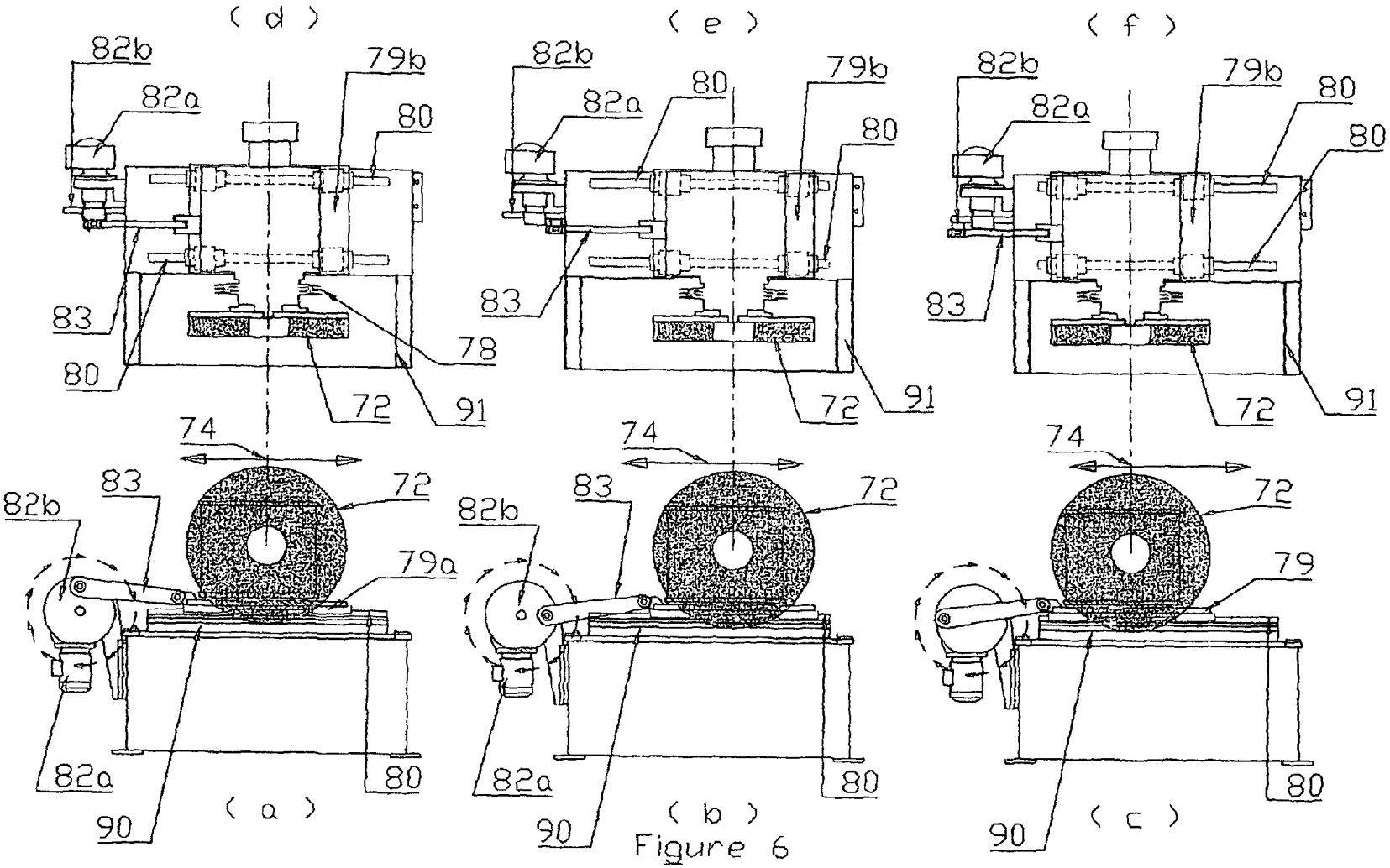

Aspects of the present invention depend upon the stable nature of the support structure to allow the above features. FIG. 6 provides illustrations a-f of the movement of a grinding machine in accordance with aspect of the present invention during different stages of an oscillation path or cycle. In FIG. 6*a/d* a grinding surface 72 is centralised upon an arm 79*b* secured to a platform 79*a* as the support structure 79. The whole support structure 79 moves on guide rails 80 to oscillate in the direction of arrowheads 74 between the extreme ends of an oscillation path or cycle defined by FIG. 6*b/e* and FIG. 6*c/f* respectively. The driving force for motion is provided by an oscillation drive mechanism 82 in the form of a motor and crank arm 83 to stimulate the relative sliding between the platform 79*a* and a base 90 along the oscillation path or cycle. Thus, the grinding surface 72 oscillates across the spring end (not shown) to provide the necessary grinding function.

The oscillation drive mechanism 82 comprises a motor 82*a* and a wheel 82*b* connected to the arm 83. Thus, different sized wheels 82*b* and/arms 83 can be used to at least in part determine the oscillation path or cycle. The arm 83 can be straight as depicted or curved or otherwise shaped.

A seal 78 is provided to substantially isolate a cabinet 91 for the grinding process from the manipulation means for the shaft or other presenter and so the grinding surface. The seal 78 is of a bellows type at least but more usually is of a labyrinth type (possibly four stage) to prove environmental separation between the grinding chamber/housing or cabinet and the moving grinding head assembly comprising the manipulation means, shaft/presenter and drive mechanism or mechanisms so removing all moving parts in the grinding machine away from grit and coolant contamination.

The support structure 79 as indicated has a platform 79*a* and an arm or upright section 79*b* which can be a simple single limb or a stable structure in itself as a bridge or girder or frame. The platform 79*a* moves on rails 80 to provide a smooth and linear motion with stable presentation of the grinding surface flatly across the end of a spring.

It will be appreciated that instead of a rotating surface that the grinding surface may be an abrasive belt. FIG. 7 provides a schematic illustration of such a machine in which as previously a fixed mounting 200 is provided for a spring 221 in a cabinet 225 for debris containment. A presenter 226 extends through a partition and seal to present an abrasive grinding belt arrangement 222. The arrangement 222 has a belt 322 which moves in the direction of arrowheads 201 consistently or in the opposite direction or switches between directions. In any event, the presenter 226 acts, like the shaft 26 previously, to present the grinding surface 322 and extend from a stable support structure (not shown). The support structure can then translate and transfer the oscillations to the grinding surface as required.

As indicated above by providing a stable support structure more consistent presentation of the grinding surface can be achieved. Generally, the support structure is provide within housing but as shown in FIG. 8 a housing 400 itself can provide part of the support structure for the grinding surface 422 with a grinding drive mechanism 427. In such circumstances the whole housing 400 or a chassis part 400*a* could be moved or driven by the oscillation drive mechanism along the oscillation path or cycle. Such oscillation will be across an end of a mounting 424 and so springs 421 held therein to grind the ends of those springs 421. The oscillation drive mechanism may be rollers or pneumatic arms/rams to manipulate the whole housing 400 or chassis 400*a* as required. It will be understood in such circumstances seals 450 will be required between the housings/cabinets and, where provide, the chassis 400*a* and the remainder of the housing 400.

It will also be understood that as illustrated by shadow 600 in FIG. 2 both ends of a spring or springs may be processed simultaneously by grinding at the same time or alternately. In such circumstances the mountings 24 may be a carousel fixed in use with a known location determined by bolts or other fixings but turn-able to locate other springs in the carousel when it is their turn.

Grinding machines in accordance with aspects of the present invention may be dry or use water or another liquid as a coolant.

Modifications and alter alterations to the example embodiments of aspects of the present invention will be understood by persons skilled in the technology. Thus, whilst in accordance with aspects of the present invention the grinding surface moves laterally and the mounting tooling in the form of a jig or clamp is stationary the manner of achieving such a relationship may vary as appreciated by persons skilled in the technology. For example, an alternative to that described above would be to provide a stable support structure for the grinding surface on rails but rather than a crank arm and motor use another form of prime mover such as provide a pneumatic or hydraulic ram or servo motor drive to create the horizontal or other lateral movement.

It will be appreciated by those skilled in the art that any number of combinations of the aforementioned features and/or those shown in the appended drawings provide clear advantages over the prior art and are therefore within the scope of the invention described herein.

The invention claimed is:

1. A grinding machine for grinding an end of a spring, the machine comprising a fixed spring mounting, which is fixable in a known position in the machine, for a spring or springs and a grinding surface secured to a support structure and arranged within the support structure to relatively oscillate to and fro along a guided oscillation path or cycle across one end of the spring mounting with the grinding surface for continuous contact in use with at least one end of one spring and means to advance the continuous contact to flatten each end of the spring or springs to the grinding surface.

2. A machine as claimed in claim 1 wherein the grinding surface is arranged in use to be reciprocating laterally across the end of the mounting.

3. A machine as claimed in claim 1 wherein the grinding surface rotates in use on a shaft.

4. A machine as claimed in claim 1 wherein a shaft or presenter for the grinding surface extends through a partition to isolate the mounting from a grinding drive mechanism for the grinding surface and/or an oscillation drive mechanism for the support structure to drive the grinding surface along the oscillation path.

5. A machine as claimed in claim 4 wherein the shaft or presenter extends thorough a seal such as a bellow boot and/or a baffle seal associated with the partition.

6. A machine as claimed in claim 4 wherein the partition is a wall between separate compartments of the machine.

7. A machine as claimed in claim 1 wherein the oscillation path or cycle is lateral and/or horizontal and/or vertical and/or angled from one end of the path.

8. A machine as claimed in claim 7 wherein the oscillation path or cycle may have a wavy section or portion such as a square or saw-tooth or harmonic or non-harmonic path.

9. A machine as claimed in claim 1 wherein the platform or carrier is presented upon a bed surface or track.

10. A machine as claimed in claim 9 wherein an inter-engagement of the support structure upon the bed surface or track at least partly defines the oscillation path.

11. A machine as claimed in claim 1 wherein the shaft or presenter can rock or tilt in or on the support structure.

12. A machine as claimed in claim 1 wherein the oscillation drive includes a crank arm.

13. A machine as claimed in claim 12 wherein the machine has mountings to the support structure to allow crank arms of different length to be associated with the machine.

14. A machine as claimed in claim 12 wherein the crank arm is shaped to define in part the oscillation path in use.

15. A machine as claimed in claim 12 wherein the crank arm is of a fixed length in use along the oscillation path or cycle and the crank arm is straight or curved.

16. A machine as claimed in claim 1 wherein the grinding machine operates in use dry or with water or other coolant provided and/or with a lubricant to facilitate grinding.

17. A grinding machine for grinding an end of a spring, the machine comprising a fixed spring mounting, which is fixable in a known position in the machine, for a spring or springs and a grinding surface secured to a support structure and arranged within the support structure to relatively oscillate to and fro along a guided oscillation path or cycle across one end of the spring mounting with the grinding surface for continuous contact in use with at least one end of one spring and means to advance the continuous contact to flatten each end of the spring or springs to the grinding surface, wherein the support structure comprises a first housing or cabinet surrounding the grinding surface and the whole or a chassis part of the first housing displaced to provide relative oscillation to and fro along the oscillation path or cycle.

18. A grinding machine for grinding an end of a spring, the machine comprising a fixed spring mounting, which is fixable in a known position in the machine, for a spring or springs and a first grinding surface secured to a support structure and arranged within the support structure to relatively oscillate to and fro along a guided oscillation path or cycle across one end of the spring mounting with the grinding surface for continuous contact in use with at least one end of one spring and means to advance the continuous contact to flatten each end of the spring or springs to the grinding surface, wherein the grinding machine further comprises a second grinding surface, wherein the first grinding surface and the second grinding surface alternately or simultaneously grind in use opposite ends of a spring or springs.

19. A grinding machine for grinding an end of a spring, the machine comprising a fixed spring mounting, which is fixable in a known position in the machine, for a spring or springs and a grinding surface secured to a support structure and arranged within the support structure to relatively oscillate to and fro along a guided oscillation path or cycle across one end of the spring mounting with the grinding surface for continuous contact in use with at least one end of one spring and means to advance the continuous contact to flatten each end of the spring or springs to the grinding surface, wherein the spring mountings are presented on a rotatable carousel fixable in at least two positions to present in use the spring or springs with respective opposite ends of each spring towards the grinding surface.

20. A machine as claimed in claim 19 wherein the carousel is associated with a feed mechanism whereby further springs may be loaded into the carousel whilst one spring or set of springs has an end presented in use to the grinding surface.

* * * * *